US011821308B2

(12) United States Patent
Mahmood et al.

(10) Patent No.: US 11,821,308 B2
(45) Date of Patent: Nov. 21, 2023

(54) DISCRIMINATION BETWEEN SUBSURFACE FORMATION NATURAL FRACTURES AND STRESS INDUCED TENSILE FRACTURES BASED ON BOREHOLE IMAGES

(71) Applicant: SAUDI ARABIAN OIL COMPANY, Dhahran (SA)

(72) Inventors: Tariq Mahmood, Dhahran (SA); Otto E. Meza Camargo, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 404 days.

(21) Appl. No.: 16/697,348

(22) Filed: Nov. 27, 2019

(65) Prior Publication Data

US 2021/0156248 A1 May 27, 2021

(51) Int. Cl.
*E21B 49/00* (2006.01)
*E21B 47/002* (2012.01)

(52) U.S. Cl.
CPC ..... *E21B 49/006* (2013.01); *E21B 47/002* (2020.05); *E21B 49/003* (2013.01)

(58) Field of Classification Search
CPC .... E21B 49/006; E21B 47/002; E21B 49/003; E21B 2200/20; E21B 43/26; E21B 47/0025
See application file for complete search history.

(56) References Cited

U.S. PATENT DOCUMENTS 4,781,062 A * 11/1988 Taylor ..... E21B 47/02 73/152.16
2009/0065252 A1 3/2009 Moos et al.
2011/0064277 A1* 3/2011 Duncan ..... G01V 3/20 382/109
2012/0173216 A1* 7/2012 Koepsell ..... E21B 49/00 703/6
2013/0240211 A1 9/2013 East et al.
2014/0078288 A1* 3/2014 Wu ..... G01V 3/38 348/85

(Continued)

FOREIGN PATENT DOCUMENTS

WO 2015168417 A1 11/2015
WO 2018117890 A1 6/2018

OTHER PUBLICATIONS

H. Al-Khatib and N. Al-Adani, "The reality of borehole fracture propagation into the reservoir formation", SPWLA 50th Annual Logging Symposium, Jun. 21-24, 2009 (Year: 2009).*

(Continued)

*Primary Examiner* — Douglas Kay

(74) *Attorney, Agent, or Firm* — Bracewell LLP; Constance G. Rhebergen; Brian H. Tompkins

(57) ABSTRACT

Images of subsurface formation walls adjacent well bores are obtained by the borehole imaging systems. The borehole images are processed to characterize the nature of fractures in the formation walls. The fractures are characterized as natural fractures or stress-induced tensile fractures based on the borehole image processing for geomechanical modeling in connection with reservoir characterization, fracture modeling, and stress analysis. A capability is provided to discriminate between the natural fractures and the stress induced tensile fractures and for performance of well activities.

30 Claims, 9 Drawing Sheets

(56) References Cited

U.S. PATENT DOCUMENTS

| | | | | |
|---|---|---|---|---|
| 2015/0055438 | A1* | 2/2015 | Yan | E21B 47/00 367/73 |
| 2015/0292323 | A1 | 10/2015 | Shahri et al. | |
| 2017/0023691 | A1 | 1/2017 | Donald et al. | |
| 2017/0205531 | A1* | 7/2017 | Berard | E21B 7/04 |
| 2017/0247995 | A1 | 8/2017 | Crews et al. | |
| 2018/0172857 | A1* | 6/2018 | Lejri | G01V 1/282 |
| 2018/0209262 | A1 | 7/2018 | Roussel et al. | |

OTHER PUBLICATIONS

C. A. Barton, Discrimination of Natural Fractures from Drilling-Induced Wellbore Failures in Wellbore Image Data—Implications for Reservoir Permeability, the SPE International Petroleum Conference and Exhibition in Mexico, Villahermosa, Mexico, Feb. 2000 (Year: 2000).*

C. A. Barton and M. D. Zoback, "Discrimination of Natural Fractures From Drilling-Induced Wellbore Failures in Wellbore Image Data—Implications for Reservoir Permeability", SPE Res Eval & Eng 5 (03): 249-254, Jun. 1, 2002 (Year: 2002).*

Bagdeli, Masoud et al.; "Natural fracture characterization and wellbore stability analysis of a highly fractured southwestern Iranian oilfield" International Journal of Rock Mechanics and Mining Sciences 123 (2019) 104101; pp. 1-13.

International Search Report and Written Opinion for International Application No. PCT/US2020/062078, dated Mar. 10, 2021; pp. 1-17.

* cited by examiner

VERTICAL WELL

DEVIATED WELL

HORIZONTAL WELL

DISCRIMINATION BETWEEN SUBSURFACE FORMATION NATURAL FRACTURES AND STRESS INDUCED TENSILE FRACTURES BASED ON BOREHOLE IMAGES

BACKGROUND OF THE INVENTION

1. Field of the Invention

The present invention relates to exploration and development of hydrocarbons. More specifically, the present invention relates to geomechanical modeling of stress conditions in subsurface formations located near wellbores.

2. Description of the Related Art

Natural and stress induced tensile fractures are routinely interpreted from borehole images; they provide a unique, high-resolution, borehole centric indication of the distribution and orientation of fractures for use in reservoir characterization, fracture modelling, geomechanics and comprehensive stress analysis. Natural fractures originate due to tectonic events. Stress induced tensile fractures develop in the borehole during the process of drilling a well due to what are known as present-day stress environments near the wellbore. Present-day stress environments represent the magnitude and orientation of stress in the current geologic epoch along vertical and horizontal axes in the subsurface formations at a tectonic scale. Discrimination between natural and stress induced tensile fractures is critical and misinterpretation can lead to serious errors, not only in the stress analysis, but in the overall characterization and development of the reservoir.

Natural and stress induced tensile fractures in subsurface formations are routinely interpreted from borehole images. Borehole images provide a unique, high-resolution, borehole centric indication of the distribution and orientation of fractures for use in reservoir characterization, fracture modelling, geomechanics and comprehensive stress analysis. Natural fractures originate due to tectonic events. Stress induced tensile fractures develop in the borehole during the process of well drilling as a result of stress environments near the wellbore. Discrimination between natural and stress induced tensile fractures is critical. A misinterpretation of the source of tensile fractures in a formation can lead to serious errors, not only in the stress analysis, but in the overall characterization and development of the reservoir. Natural and stress induced tensile fractures in subsurface formations are routinely interpreted from borehole images. Borehole images provide a unique, high-resolution, borehole centric indication of the distribution and orientation of fractures for use in reservoir characterization, fracture modelling, geomechanics and comprehensive stress analysis. Natural fractures originate due to tectonic events. Stress induced tensile fractures develop in the borehole during the process of well drilling as a result of stress environments near the wellbore. Discrimination between natural and stress induced tensile fractures is critical. A misinterpretation of the source of tensile fractures in a formation can lead to serious errors, not only in the stress analysis, but in the overall characterization and development of the reservoir.

Stress induced tensile fractures interpreted from the borehole images are a key source in determining the horizontal principal stress direction. This information plays an important role in planning of the wells for conventional and unconventional reservoirs. Mostly, unconventional wells are planned to be drilled parallel to the direction of minimum principal stress to maximize the impact of stimulation and to optimize the production.

An incorrect interpretation can lead to drilling a well in the direction which is not parallel to the minimum stress direction that will have severe consequences on the production. On the other hand, natural fractures in the conventional reservoir can be "sweet spots" for planning the wells to enhance hydrocarbon production, or can cause drilling hazards during the process of drilling a well. Therefore, identification of natural fractures to confirm the presence of these features in a reservoir can have considerable financial impact on drilling and completion of the well. Identification of natural fractures in the borehole in conventional reservoirs can help in making decisions for a well testing program to target the natural fractures.

If the natural fractures are misinterpreted, failure of well testing with consequent financial losses can result. Therefore, differentiation between stress induced tensile fractures and natural fractures is critical in the development of a reservoir for conventional and unconventional hydrocarbon exploration and development. Borehole images are the best source to image natural and stress induced fractures. In fact, borehole images are the only single source to image stress induced tensile fractures.

U.S. Published Application No. 2013/0240211 involved determining mechanical properties of subsurface formation based on measures taken from sonic wellbore logs and core samples. Stress conditions within formation rock were obtained from the mechanical properties. From the determined stress conditions, fracture anisotropy characteristics of a subsurface formation were then altered to improve fracturing operations.

U.S. Published Application No. 2017/0023691 related to modeling stresses at wellbore scale. Measures such as dipole sonic image, data from a modular sonic imaging platform (or MSIP), and borehole images were used to detect a maximum stress direction in the formation rock. Conventional geomechanical modeling was then performed to quantify stress magnitudes in the formation rock, based on the detected stress regime.

U.S. Published Application No. 2018/0209262 related to evaluation of dimensions and orientations of fractures induced during hydraulic fracture. The evaluation was based on pressure response information gathered downhole in one or more wells.

In U.S. Published Application No. 2017/0247995 far field fractures in regions distant from the wellbore were investigated in a first or diagnostic well based on measures of the volumes, pressures and application (or "hit") time of fluid pressure applied in a second injection well which was a candidate for fracturing operations.

U.S. Published Application No. 2015/0292323—involve the analysis of wellbore formation wall stress, stability, strength and mud loss. The analysis was based on input parameters such as mechanical properties of the formation and pore pressure in the well as well as far-field stress conditions distant from the wellbore.

SUMMARY OF THE INVENTION

Briefly, the present invention provides a new and improved method of performing well operations in a subsurface formation based on determination of nature of fractures in the subsurface formation. Measures representing an image of the borehole wall at a depth of interest in the well are obtained with a borehole imaging logging tool. The obtained measures representing the image of the borehole wall are then processed in a data processing system to determine from the obtained measures the nature of fractures present in the borehole wall. The processing in the data processing system determines a direction of propagation of fractures present in the borehole wall with respect to a longitudinal axis of the borehole. A geomechanical model of stress in the subsurface formation is then formed in the data processing system to indicate vectors of component formation stresses. A measure of true dip magnitude and direction of the longitudinal axis of the borehole is then determined with the data processing system with respect to a direction of the component formation stress vectors. An indication of the nature of fractures in a borehole wall is then formed in the data processing system based on: the determined direction of propagation of fractures in the borehole wall; the vectors of component formation stress in the formed geomechanical model; and the determined measure of true dip magnitude and direction of the longitudinal axis of the borehole with respect to a direction of the component formation stress vectors. The formed indication of the nature of fractures in a borehole wall is stored is then formed in the data processing system for geomechanical modeling of the subsurface formation. Well operations are then performed in the subsurface formation based on the formed indication of the nature of the fractures in the borehole wall of the well.

The present invention also provides a new and improved apparatus for determining the nature of fractures in a borehole wall of a well in a subsurface formation based on borehole images of the borehole walls to perform well operations in the subsurface formation. The apparatus includes a borehole imaging logging tool obtaining measures representing an image of the borehole wall at a depth of interest in the well. The apparatus also includes a data processing system which processing the obtained measures representing the image of the borehole wall to determine from the obtained measures the nature of fractures present in the borehole wall for then performing well operations in the subsurface formation.

The data processing system determines a direction of propagation of fractures present in the borehole wall with respect to a longitudinal axis of the borehole, and forms a geomechanical model of stress in the subsurface formation to indicate vectors of component formation stresses. The data processing system determines a measure of true dip magnitude and direction of the longitudinal axis of the borehole with respect to a direction of the component formation stress vectors. The data processing system forms an indication of the nature of fractures in a borehole wall based on the determined direction of propagation of fractures in the borehole wall; the vectors of component formation stress in the formed geomechanical model; and the determined measure of true dip magnitude and direction of the longitudinal axis of the borehole with respect to a direction of the component formation stress vectors. The data processing system then stores the formed indication of the nature of fractures in a borehole wall for then performing well operations in the subsurface formation.

The present invention also provides a new and improved computer implemented method of determining the nature of fractures in a borehole wall of a well in a subsurface formation based on borehole images of the borehole walls for geomechanical modeling of the subsurface formation. The method is performed in a data processing system having a processor and a memory. The computer implemented includes storing in the memory computer operable instructions for performing the determination of the nature of fractures in the borehole wall based on borehole images of the borehole walls, and determining in the processor under control of the stored computer operable instructions the nature of the fractures in the borehole wall for then performing well operations in the subsurface formation.

The nature of fractures is determined in the processor by performing computer implemented steps which include determining a direction of propagation of fractures present in the borehole wall with respect to a longitudinal axis of the borehole. The computer implemented steps also include forming a geomechanical model of stress in the subsurface formation to indicate vectors of component formation stresses, and determining a measure of true dip magnitude and direction of the longitudinal axis of the borehole with respect to a direction of the component formation stress vectors.

The computer implemented steps further include forming an indication of the nature of fractures in a borehole wall based on the determined direction of propagation of fractures in the borehole wall; the vectors of component formation stress in the formed geomechanical model; and the determined measure of true dip magnitude and direction of the longitudinal axis of the borehole with respect to a direction of the component formation stress vectors; and storing the formed indication of the nature of fractures in a borehole wall for geomechanical modeling of the subsurface format for then performing well operations in the subsurface formation.

The present invention also provides a new and improved data processing system for determining the nature of fractures in a borehole wall of a well in a subsurface formation based on borehole images of the borehole walls to perform well operations in the subsurface formation. The data processing system includes a memory storing computer operable instructions for determination of the nature of fractures in the borehole wall based on borehole images of the borehole walls, and a processor operating under control of the stored program instructions to perform the determination of the nature of fractures in the borehole wall.

The processor determines the nature of the fracture by determining a direction of propagation of fractures present in the borehole wall with respect to a longitudinal axis of the borehole, and forming a geomechanical model of stress in the subsurface formation to indicate vectors of component formation stresses. The processor in determining the nature of the fracture also determines a measure of true dip magnitude and direction of the longitudinal axis of the borehole with respect to a direction of the component formation stress vectors, and forms an indication of the nature of fractures in a borehole wall based on the determined direction of propagation of fractures in the borehole wall; the vectors of component formation stress in the formed geomechanical model; and the determined measure of true dip magnitude and direction of the longitudinal axis of the borehole with respect to a direction of the component formation stress vectors. The memory of the data processing system stores the formed indication of the nature of fractures in a borehole wall for then performing well operations in the subsurface formation.

The present invention also provides a new and improved data storage device which having stored in a non-transitory computer readable medium computer operable instructions for causing a data processing system comprising a memory and a processor to determine the nature of fractures in a borehole wall of a well in a subsurface formation based on borehole images of the borehole walls to perform well operations in the subsurface formation. The instructions stored in the data storage device causing the data processing system to determine a direction of propagation of fractures present in the borehole wall with respect to a longitudinal axis of the borehole, and form a geomechanical model of stress in the subsurface formation to indicate vectors of component formation stresses.

The instructions stored in the data storage device also cause the data processing system to determine a measure of true dip magnitude and direction of the longitudinal axis of the borehole with respect to a direction of the component formation stress vectors, and form an indication of the nature of fractures in a borehole wall based on the determined direction of propagation of fractures in the borehole wall; the vectors of component formation stress in the formed geomechanical model; and the determined measure of true dip magnitude and direction of the longitudinal axis of the borehole with respect to a direction of the component formation stress vectors. The instructions then cause storage in memory of the formed indication of the nature of fractures in a borehole wall for then performing well operations in the subsurface formation.

DETAILED DESCRIPTION OF THE PREFERRED EMBODIMENTS

Figure 1:
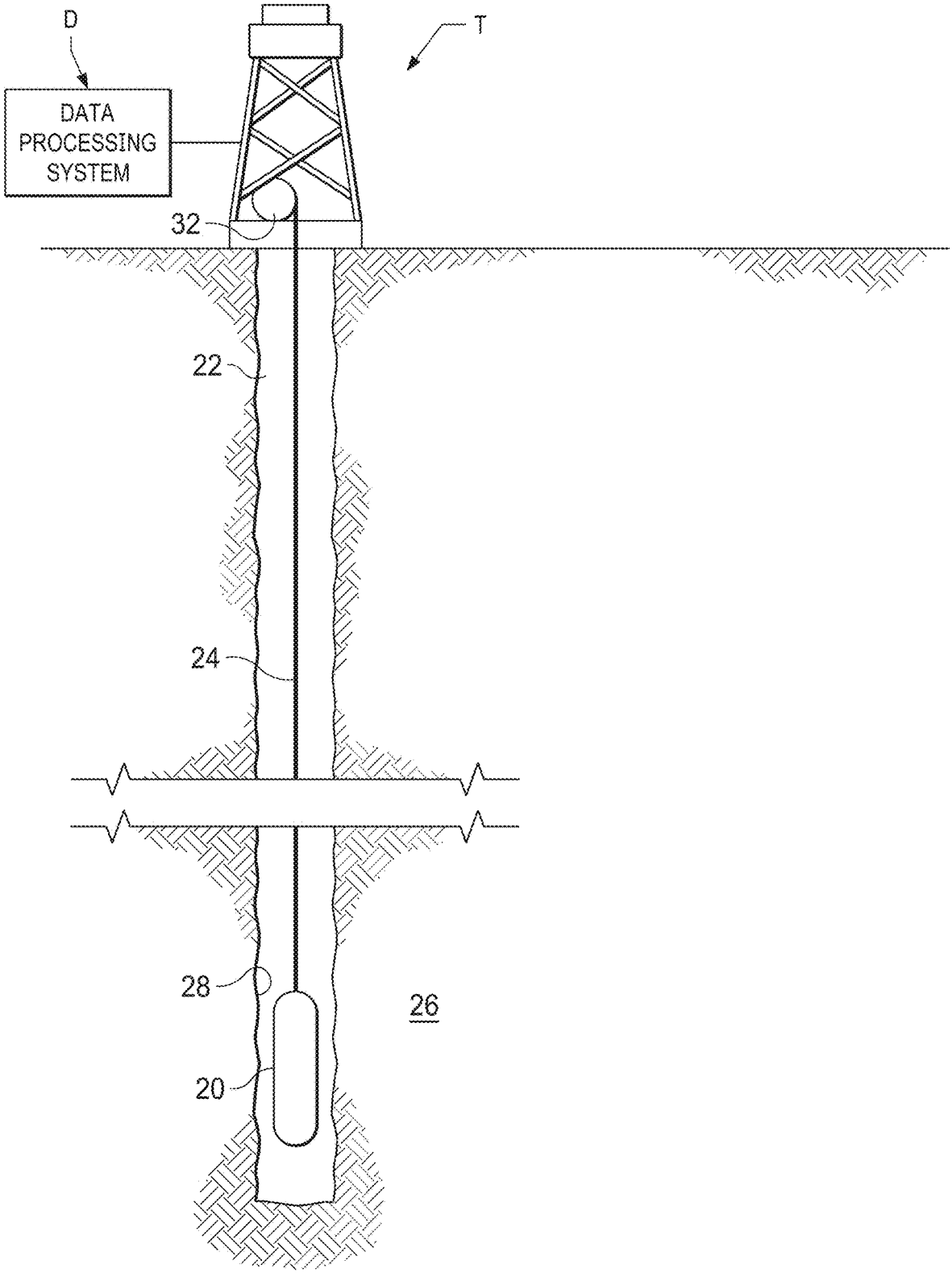
FIG. 1 is a schematic diagram, partly in cross-section, of a borehole imaging well logging system according to the present invention deployed in a subsurface formation penetrated by a wellbore.

In the drawings, a borehole imaging well logging system T is shown in FIG. 1. The ground penetrating radar well logging T includes a sonde or housing body 20 which is suspended for movement in a wellbore 22 for movement by a wireline logging cable 24. The well logging tool T is moved in the wellbore 22 to well depths of interest in a formation 26 which is of interest for forming images of a rock formation wall 28 surrounding the wellbore 22.

Figure 14:
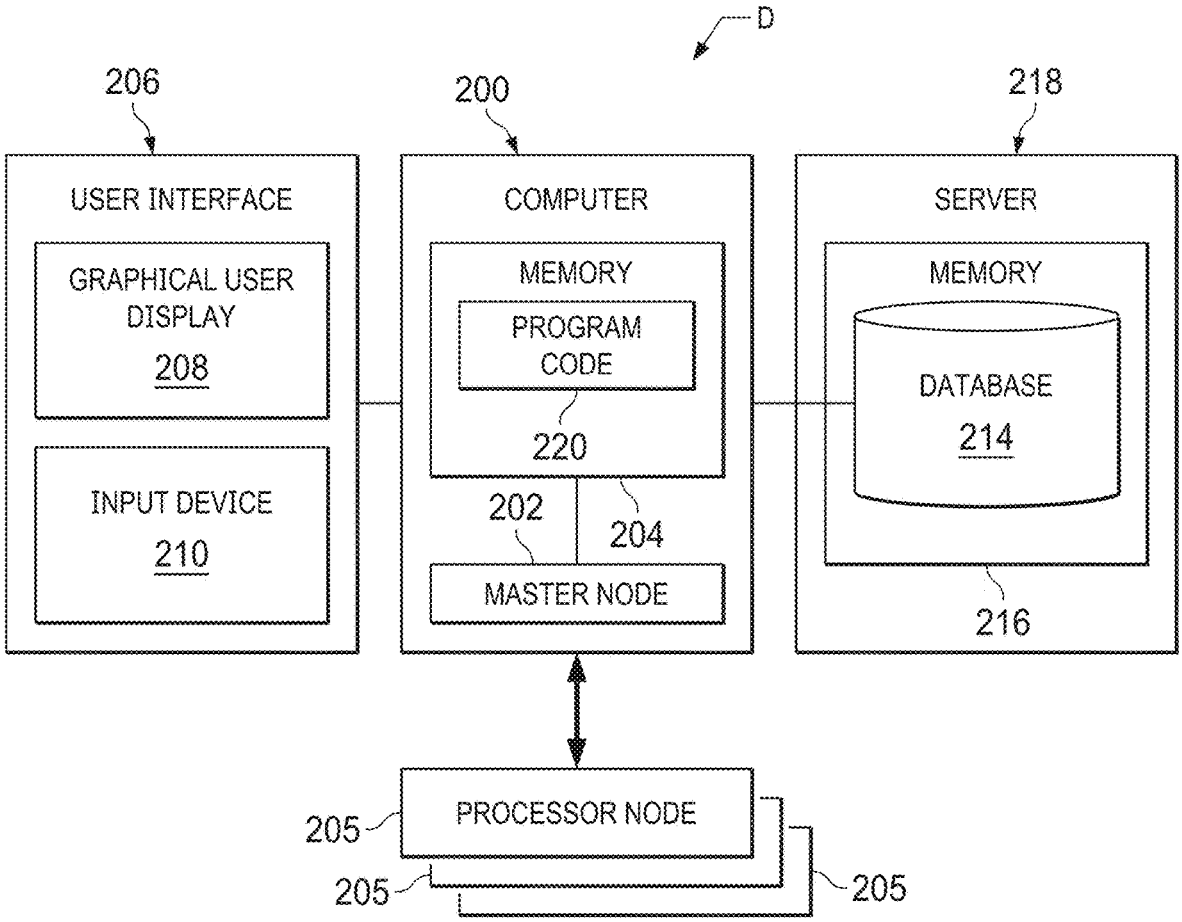
FIG. 14 is a schematic diagram of the data processing system of the borehole imaging well logging system of Claim 1.

Images of the formation borehole walls 28 are obtained by conventional borehole image logging techniques in the downhole logging tool T and from the downhole sonde 20 over the wireline logging cable 24 to a data processing system D (FIGS. 1 and 14). Borehole image data measurements from the logging tool T are received by the data processing system D as functions of borehole depth or length of extent in wellbore 22.

A surface depth measurement system, such as a depth measure sheave wheel 32 and associated circuitry is provided to indicate depth of the logging tool T in the wellbore 22. The borehole image data from the downhole borehole image logging tool T are recorded or stored as functions of borehole depth in memory of the data processing system D. Once recorded, the borehole image measurements are processed according to the present invention in the data processing system D. The present invention provides a systematic workflow to discriminate and discriminates natural fractures (NF) from stress induced tensile fractures (SITF) using borehole images provided by the borehole image logging T.

Figure 2:
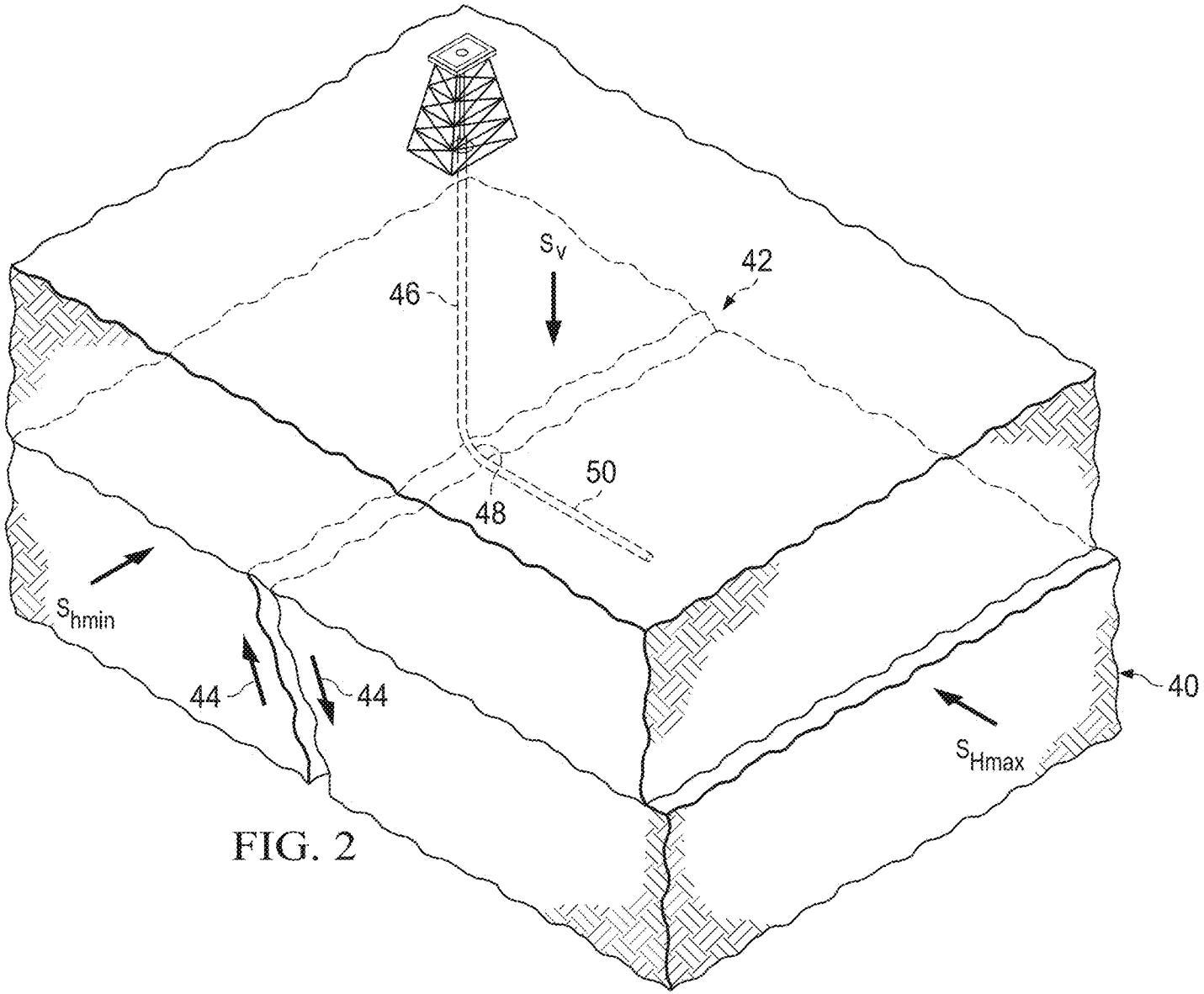
FIG. 2 is a schematic diagram of formation stress conditions in subsurface formation rock for a normal fault regime with wells encountered in hydrocarbon exploration and production.

FIG. 2 is a schematic diagram illustrating what is known as a normal fault regime being present in a subsurface formation 40 having a fault plane as indicated at 42. The subsurface formation 40 exemplifies what is known as a normal fault regime. Stress conditions along the fault plane 42 are indicated by stress tensors 44. The example presence of a vertical well 46, a deviated well 48, or a horizontal well 50 is indicated schematically in FIG. 2. Each of these wells represent an example well which could be present in a normal fault regime, and in which borehole imaging logging operations are performed according to the present invention. The subsurface formation 40 shown in FIG. 2 under a normal fault regime is subjected to a vertical stress as indicated at $S_v$, a maximum horizontal principal stress as indicated at $S_{Hmax}$, and a minimum horizontal principal stress as indicated $S_{Hmin}$.

Figure 3:
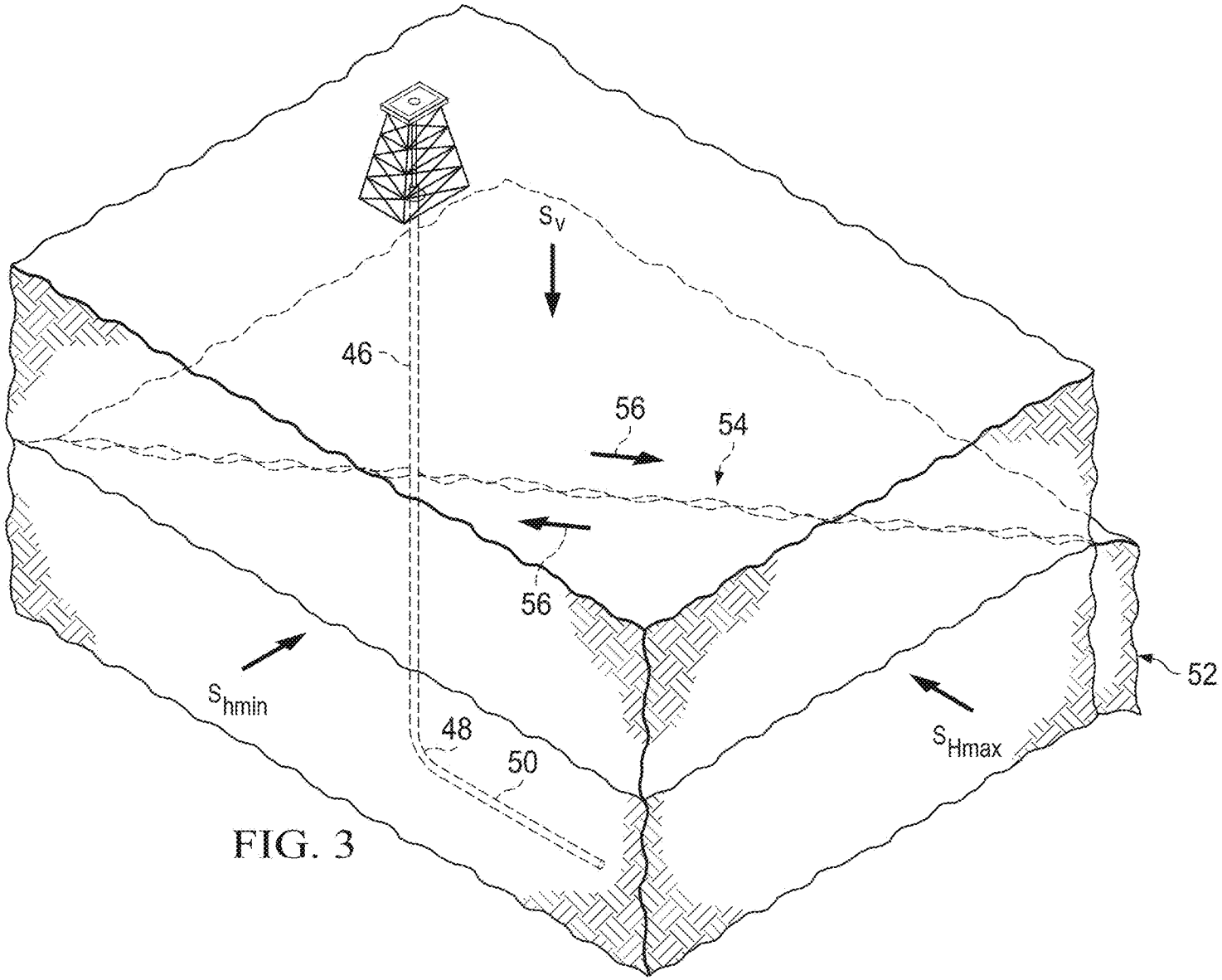
FIG. 3 is a schematic diagram of formation stress conditions in subsurface formation rock for a strike slip fault regime with wells encountered in hydrocarbon exploration and production.

FIG. 3 is a schematic diagram illustrating what is known as a strike slip fault regime being present in a subsurface formation 52 having a fault plane as indicated at 54. The subsurface formation 52 exemplifies what is known as a strike slip fault regime. Stress conditions along the fault plane 52 are indicated by stress tensors 56. The example presence of vertical well 46, deviated well 48, or a horizontal well 50 is again indicated schematically in FIG. 3. Each of the wells 46, 48 or 50 again represent an example well which may be present in a strike slip fault regime and in which borehole imaging logging operations are performed according to FIG. 1. The subsurface formation 52 shown in FIG. 3 under a strike slip fault regime is subjected to a vertical stress as indicated at $S_v$, a maximum horizontal principal stress as indicated at $S_{Hmax}$ and a minimum horizontal principal stress as indicated $S_{Hmin}$.

Figure 4:
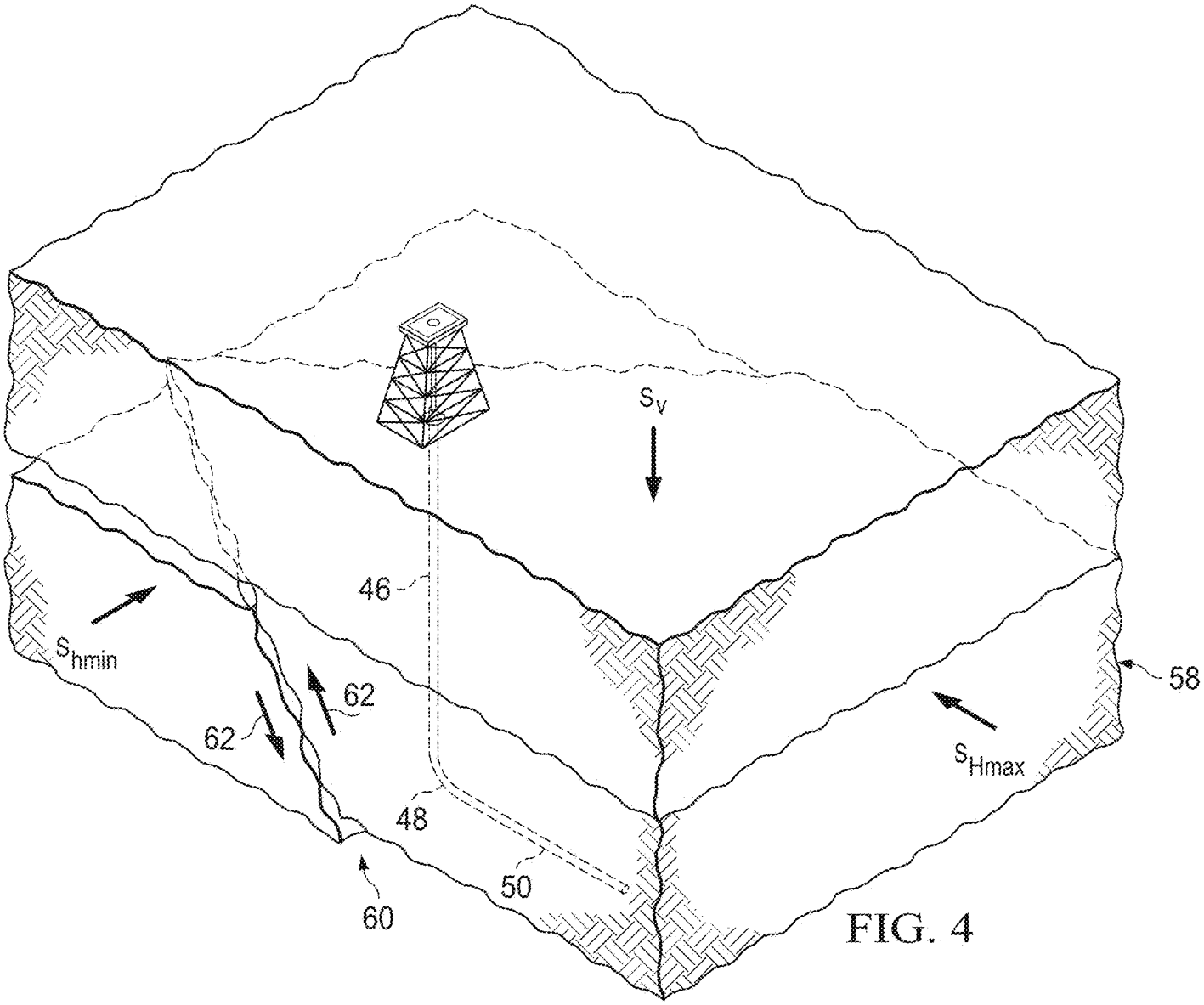
FIG. 4 is a schematic diagram of formation stress conditions in subsurface formation rock for a reverse fault regime with wells encountered in hydrocarbon exploration and production.

FIG. 4 is a schematic diagram illustrating what is known as a reverse fault regime being present in a subsurface formation 58 having a fault plane as indicated at 60. The subsurface formation 58 exemplifies what is known as a reverse fault regime. Stress conditions along the fault plane 60 are indicated by stress tensors 62. The example presence of vertical well 46, deviated well 48, or a horizontal well 50 is again indicated schematically in FIG. 4. Each of the 46, 48 and 50 represent an example well which could be present in a reverse fault regime, and in which borehole imaging logging operations are performed according to FIG. 1. The subsurface formation 58 shown in FIG. 4 under a reverse fault regime is subjected to a vertical stress as indicated at $S_v$, a maximum horizontal principal stress as indicated at $S_{Hmax}$ and a minimum horizontal principal stress as indicated at $S_{Hmin}$.

Stress induced tensile fractures propagation in wellbores is a direct result of the stress concentration around the wellbore, whether vertical, deviated or horizontal. Propagation of stress induced tensile fractures is governed according to what is known as Anderson's Theory of Faulting in the following manner:

| | $S_1$ | | $S_2$ | | $S_3$ |
|---|---|---|---|---|---|
| FIG. 2: Normal Fault Regime | $S_v$ | ≥ | $S_{Hmax}$ | ≥ | $S_{Hmin}$ |
| FIG. 3: Strike Slip Faulting Regime | $S_{Hmax}$ | ≥ | $S_v$ | ≥ | $S_{Hmin}$ |
| FIG. 4: Reverse Faulting Regime | $S_{Hmax}$ | ≥ | $S_{Hmin}$ | ≥ | $S_v$ |

where $S_1$, $S_2$ and $S_3$ are the three principal stresses; $S_v$ is the vertical principal stress; $S_{Hmax}$ is the maximum horizontal principal stress; and $S_{Hmin}$ is the minimum horizontal principal stress.

Depending on the stress regime in a subsurface formation and the orientation of a well (vertical, diverted, or horizontal) in the formation, borehole imaging logs which are obtained from the borehole imaging well logging tool T shown in FIG. 1 exhibit different borehole log images based on the present-day stress regime present in the subsurface formations adjacent the well.

Normal Fault Regime Borehole Images of Stress Induced Tensile Fractures

Tensile Fractures resulting from drilling are known to propagate in a manner such that the fracture plane is perpendicular to the least principal stress ($S_3$). As a result of this, in a normal fault regime such as shown in FIG. 2, Stress Induced Tensile Fractures for a vertical well can appear in a borehole image as shown schematically at 70 in FIG. 5 parallel to a longitudinal axis 72 of wellbore 22 and spaced 180° apart from each other about the circumference of the formation wall adjacent wellbore 22 being imaged. For horizontal wells, the direction of the well borehole 22 with respect to the direction of minimum horizontal stress governs the borehole image obtained by logging. The image may be that shown at 70 in FIG. 5 or that shown schematically at 74 in FIG. 6. Stress induced tensile fractures for a horizontal well in a normal fault regime can also appear as shown at 70 in FIG. 5 as well.

Figure 6:
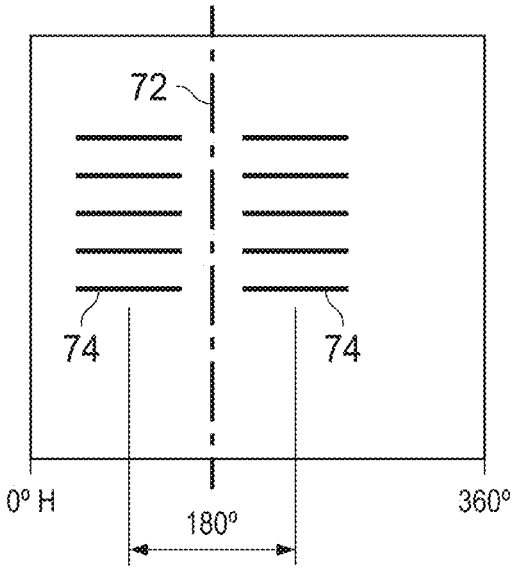
Figure 7:
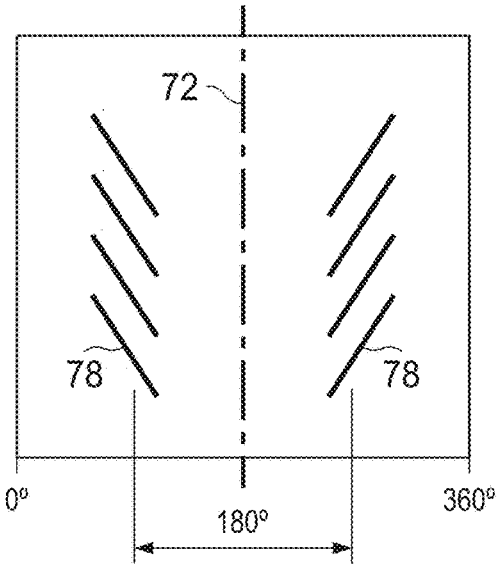

Stress Induced Tensile Fractures for a horizontal well in a formation under a normal fault regime can in other cases appear as shown schematically in FIG. 6 as a spaced group of parallel horizontal lines 74 spaced apart from each other about the circumference of the formation wall being imaged. Stress induced tensile fractures for a deviated well under a normal fault regime appear at an angle to the borehole axis 72 as shown in FIG. 7.

Strike Slip Fault Regime Borehole Images of Stress Induced Tensile Fractures

Figure 5:
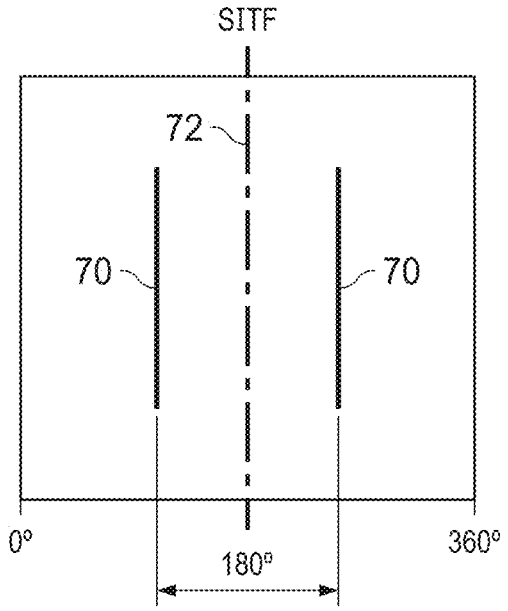
FIGS. 5, 6, 7, 8, and 9 are schematic diagrams indicating presence of stress induced tensile force conditions in an example well borehole image display.

In a strike slip fault regime such as shown in FIG. 3, Stress Induced Tensile Fractures for a vertical well can also appear as shown at 70 in FIG. 5. Stress induced tensile fractures for a horizontal well in a strike slip fault regime can appear as shown at 70 in FIG. 5 as well. Stress Induced Tensile Fractures for a horizontal well in a formation under a strike slip fault regime can also appear as shown schematically at 74 in FIG. 6 as a spaced group of parallel horizontal lines 74 spaced apart from each other about the circumference of the formation wall adjacent wellbore 22 being imaged. Stress induced tensile fractures for a deviated well under a strike slip fault regime appear as shown schematically at 78 in FIG. 7 as a vertical series of inclined lines with respect to the borehole axis 72.

Reverse Fault Regime Borehole Images of Stress Induced Tensile Fractures

Figure 8:
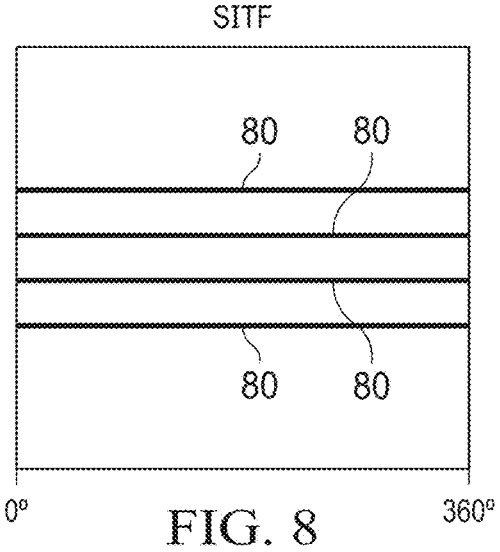
Figure 9:
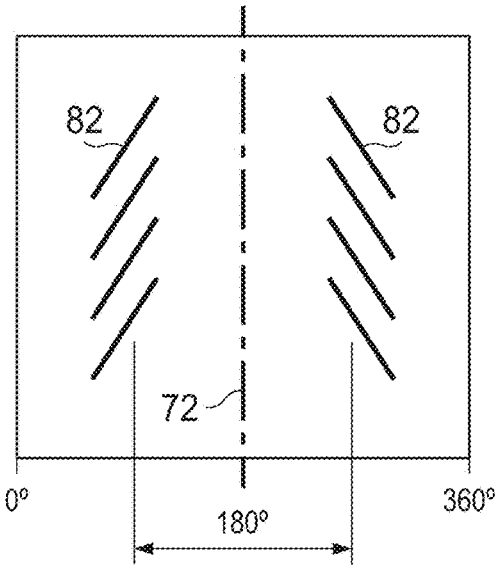

In a reverse fault regime such as shown in FIG. 4, Stress Induced Tensile Fractures for a vertical well can appear as shown schematically at 80 in FIG. 8 as a vertical series of horizontal lines extending circumferentially about the image of the borehole wall. For a horizontal well in a reverse fault regime, stress induced tensile fractures can appear as spaced lines 70 parallel to the axis of wellbore 22 and spaced 180 apart about the circumference of the formation wall being imaged, as shown in FIG. 5. Stress Induced Tensile Fractures for a deviated well in a formation under a reverse fault regime as shown schematically in FIG. 9 as a vertical series of inclined lines 82 with respect to the borehole axis 72.

Example Borehole Log Images

Figure 10:
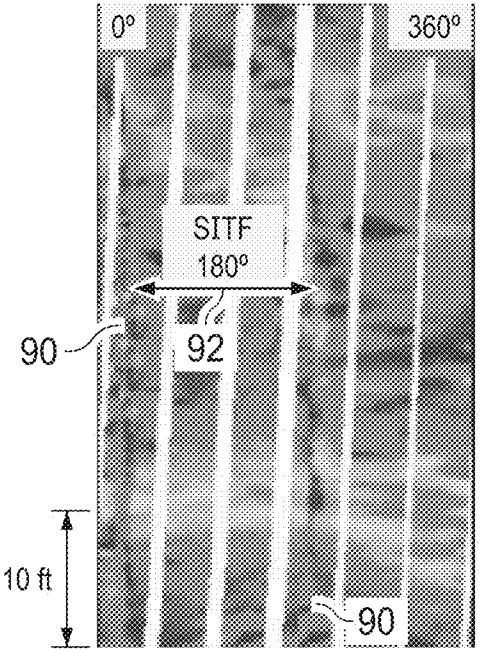
FIGS. 10, 11 and 12 are example displays of borehole images indicating the presence of stress-induced tensile fractures and natural fractures in a borehole wall adjacent a well.
Figure 11:
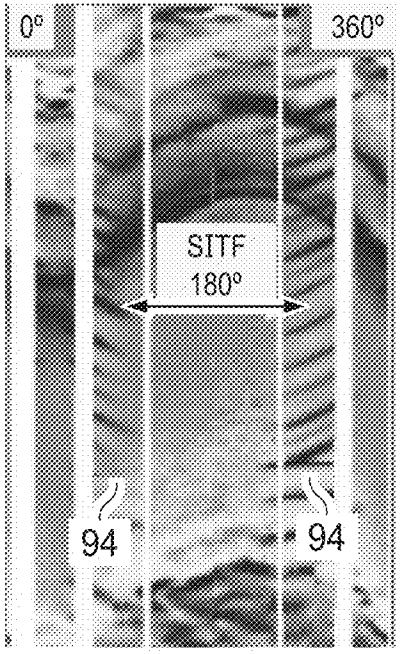
Figure 12:
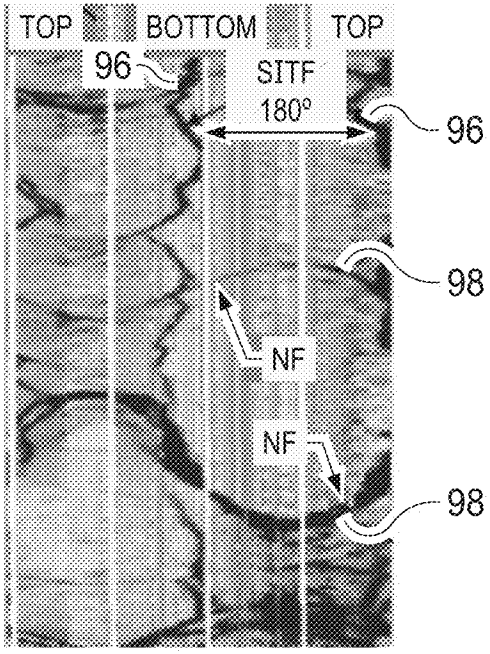

FIGS. 10, 11 and 12 are examples of actual images borehole imaging logs from borehole imaging logging tools. FIG. 10 is a representation of a borehole image from a vertical well. It is to be noted that the image in FIG. 10 contains a pair of vertical lines 90 comparable to those indicated schematically in FIG. 5 spaced from each other at 1800 as indicated by arrow 92. The pair of vertical lines 90 are indicative of stress induced tensile fractures in the formation wall in adjacent the borehole.

FIG. 11 is a representation of a borehole image from a deviated well. It is to be noted that as indicated at 94 a series of lines are present at an angle to the borehole axis indicative of stress induced tensile fractures for a deviated well comparable to those shown schematically in FIG. 9.

Figure 13:
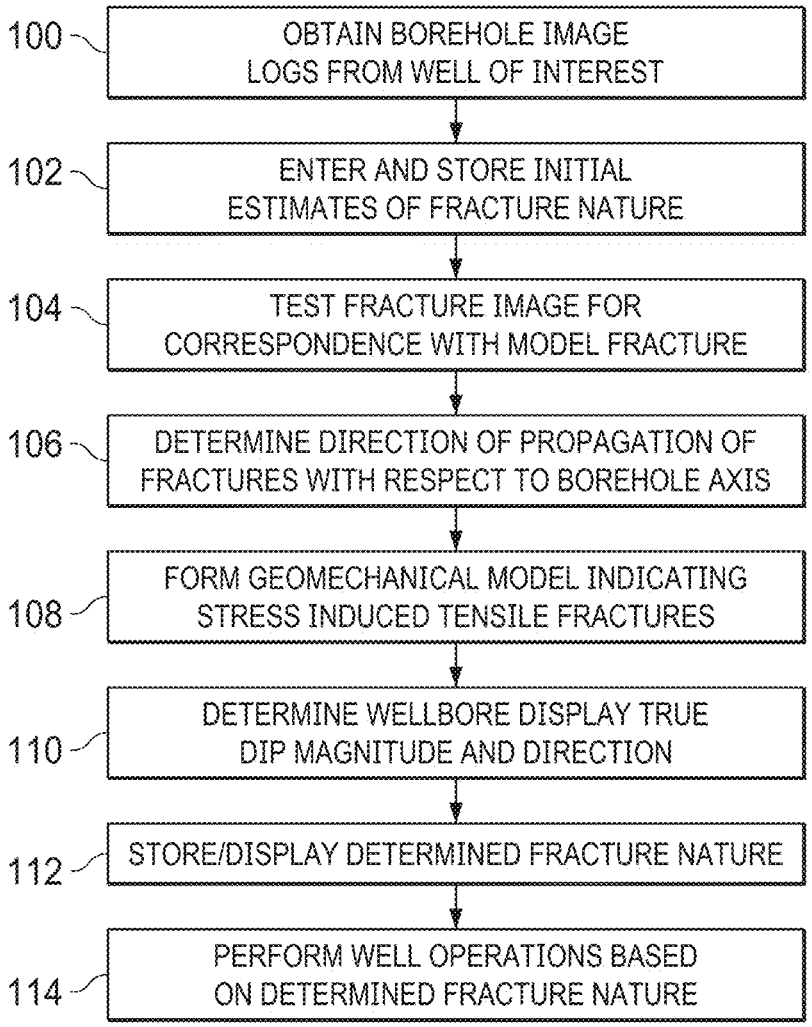
FIG. 13 is a functional block diagram of a flow chart of data processing steps according to the present invention for geomechanical modeling of stress conditions in subsurface formations located near wellbores.

FIG. 12 is a representation of a borehole image from a horizontal well. It is to be noted that as indicated at 96 a pair of vertical lines are indicative of a stress induce tensile fracture are present comparable to those indicated schematically in FIG. 5 spaced from each other at 180°. FIG. 13 also contains as indicated at 98 there are at least two sinusoidally extending lines indicating the presence of natural fractures in the formation wall adjacent the horizontal wellbore at the drilled depth location of the borehole imaging logging.

Processing Workflow

A comprehensive computer implemented methodology for discrimination between subsurface formation natural fractures and stress induced tensile fractures based on borehole images according to the present invention is illustrated schematically by a workflow or flow chart F in FIG. 13. As will be described, certain portions of the flow chart F illustrate the structure of the logic of the present invention as embodied in computer program software.

Those skilled in the art will appreciate that these portions of flow chart F also illustrate functions which may be performed by structures of computer program code elements, including logic circuits on an integrated circuit, that function according to the present invention. The present invention is practiced in its essential embodiment by a machine component that renders the program code elements in a form that instructs a digital processing apparatus (that is, a data processing system or computer) to perform a sequence of data transformation or processing steps corresponding to those shown.

As are seen from the flow chart F, processing according to the present invention begins with obtaining borehole image logs from well of interest, as indicated generally at 100. The borehole image logs are obtained at depths or well locations of interest with the borehole imaging well logging system T (FIG. 1). The obtained borehole image logs are received and stored in the data processing system D, where they are available for initial inspection and evaluation by reservoir engineers.

During step 102, initial estimates made by reservoir engineers regarding the nature of fractures present in the obtained borehole image logs at a selected depth or well location are also entered as inputs for processing in the data processing system D. The entered input data regarding the nature of the fracture plane during step 102 is based on reservoir engineer analysis and observations of the borehole image logs provided during step 100.

The data entries regarding the nature of the fractures of interest are based on visual interpretation criteria provided by reservoir engineers. The data entries during step 102 regarding the nature of fractures are estimates of the likelihood or possibility of individual fractures indicated in the borehole image logs being either a natural fracture or a stress induced tensile fracture at the well location of interest. Such an estimate is made based on the appearance of the feature on the borehole images as being either planar or non-planar in nature. Examples of non-planar borehole images are shown at 90-94 in FIGS. 10-11 of the drawings and planar borehole images are shown in FIG. 12.

Step 104 involves performing a computerized test as to whether the fracture image in the borehole image log at the well location of interest is found to correspond to or fit to a sinusoidal waveform. Performance of step 104 is based on quantitative interpretation using a sinusoid fit by computerized modeling techniques. Analysis during step 104 of the borehole image is performed to determine the probability of the selected features in the borehole image being analyzed as being either a natural fracture or a stress induced tensile fracture.

Natural fractures usually appear in borehole images from borehole image logging as planar features, discordant to bedding of the subsurface formation. Examples of planar borehole images are shown at 98 in FIG. 12 of the drawings. In borehole images from borehole image logs, dipping or inclined natural fractures appear as sinusoidal traces in vertical, deviated and horizontal wells and a flexible sinusoid will perfectly fit on the fracture planes. Examples of dipping or inclined natural fractures appearing as sinusoidal traces are shown at 96 and 98 in FIG. 12 of the drawings.

Step 104 also takes into account on the appearance of feature as a symmetric or non-symmetric appearance. If a non-symmetric appearance is present, the borehole image exhibits convex and concave appearance. In such a case, the fracture image does not correspond to or fit to a sinusoidal waveform.

Step 106 which follows step 104 is performed to determine a direction of propagation of fractures with respect to the axis of the wellbore. Step 106 is preferably performed by a geomechanical numerical simulator, such as that available as Visage™ software. It should be understood that other geomechanical numerical simulators operating with a finite element methodology may be used to determine the required solution. It should be understood that other geomechanical numerical simulators operating with a finite element methodology may be used to determine the direction of propagation of fractures during step 106. The results of step 106 are used to determine if the fractures indicated in the borehole images are either natural fractures or stress induced tensile fractures. As has been discussed in preceding paragraphs with respect to FIG. 5, stress induced tensile fractures propagate in a direction parallel to the borehole axis (180 degrees apart) in a well drilled parallel to one of principal stress axes as a result of the stress regime present in the formation. As has also been discussed, stress induced tensile fractures can also propagate at an azimuth to an axis where the compressive stress concentration is a minimum stress.

Step 108 involves formation of a three-dimensional computerized geomechanical model of stress in the subsurface formation where the well of interest where the borehole image logs were obtained during step 100. Step 108 is also performed by a geomechanical numerical simulator such as the previously mentioned Visage™ software system. It should be understood that other geomechanical numerical simulators operating with a finite element methodology may be used to determine the required solution. A description of this type of geomechanical numerical simulation is contained, for example, in Herwanger, J. and Koutsabeloulis, N. C.: "Seismic Geomechanics—How to Build and Calibrate Geomechanical Models using 3D and 4D Seismic Data", 1 Edn., EAGE Publications b.v., Houten, 181 pp., 2011. Performance of step 108 produces a 3D stress tensor incorporating into the geomechanical model stress magnitudes and orientations that vary both laterally and vertically.

The computerized geomechanical model formed during step 108 indicates and the probability of the presence of either natural fractures or stress induced tensile fractures at the well location of interest in the borehole. The geomechanical model formed during step 108 is dependent on the stress regime currently present in the subsurface formation at the well location of interest.

The geomechanical model formed during step 108 can also provide indications of tensile failure of the wellbore. The geomechanical model so formed also indicates the direction of propagation of the stress induced tensile fractures around the wellbore circumference and orientation of the stress induced tensile fractures with respect to the wellbore axis. The propagation of stress induced tensile fractures in a wellbore is strongly dependent on the stress regime currently present. As has been discussed with respect to FIGS. 2 through 4, the presence of either a normal-faulting-regime, strike-slip-faulting regime or a reverse-faulting regime has significant effects on the images resulting from borehole imaging logging.

Step 110 involves the determination of true dip magnitude and direction of the fracture with respect to the currently indicated maximum principal stress direction from the three-dimensional geomechanical model resulting from step 108. Step 110 is performed by computerized vector analysis by measuring the sinusoid's amplitude to compute apparent dip magnitude which is converted to true dip magnitude with respect to wellbore deviation. Step 110 is simultaneously performed by computerized vector analysis by measuring the sinusoid's lowest point distance from North to compute apparent dip direction which is converted to true dip direction with respect to wellbore orientation.

During step 112, the determined fracture nature indicated by the geomechanical and the true dip magnitude and direction of the wellbore with respect to the currently indicated maximum principal stress direction resulting from the preceding steps 108 and 110 are stored in memory of the data processing system and provide for further exploration and production of the subsurface reservoir.

During step 114, well operations such as well fracturing or drilling of additional for the purposes of fracturing may be performed based on the determined fracture nature. In unconventional wells where fracturing operations are performed in the subsurface formation, the well operations take the form of drilling one or more wells at locations in a direction parallel to the direction of the minimum principal stress indicated by stress induced tensile fractures. Fracturing operations are then performed in the drilled unconventional wells.

For conventional wells, drilling or fracturing can be directed to regions of the subsurface formations where natural fractures of types conducive to increased production are likely to be present. Drilling operations in conventional wells are also enhanced by drilling in directions to avoid formations or layers regions in which identified natural fractures are indicated as not being hydraulically conductive. Well operations are also improved by avoiding areas indicated to contain fractures which are likely to cause complications in drilling operations or otherwise adversely impact drilling operations.

The present invention workflow concatenates five criteria is a systematic method based on visual interpretation criteria (qualitative borehole image interpretation) and computational interpretation criteria (quantitative borehole image interpretation) (FIG. 13). These five criteria are listed below:

1. Nature of the fracture plane observed on the image logs.
2. Does a flexible "Sinusoid" perfectly fits on a plane?
3. Propagation of fractures parallel to borehole axis/one of the principal stress direction.
4. Geomechanical modeling of Stress Induced Tensile Fractures.
5. Relationship of true dip magnitude and dip direction with respect to present day maximum principal stress direction.

These five criteria are concatenated in the order that qualitative interpretation diminishes progressively in the order of criteria from 1 to 5. Conversely, quantitative interpretation diminishes progressively in the order of criteria from 5 to 1. Therefore, Criteria 1 represents 100% qualitative interpretation and Criteria 5 represents 100% quantitative interpretation. However, criteria 2, 3 & 4 have both qualitative and quantitative interpretation. Each criteria indicates a possibility of the type of features identified on the borehole images. Discrimination of the feature types is based on the maximum number of criteria associated with that feature. Generally, the borehole image interpretation is qualitative interpretation by any analyst and it is not enough to differentiate natural fractures vs stress induced fractures as it can lead to misinterpretation. Therefore, qualitative and quantitative interpretations combined can address the issue described in this patent.

These five criteria are interlinked and can be applied simultaneously during the process of borehole image interpretation to discriminate natural versus stress induced tensile fractures. The five criteria are concatenated in the order that qualitative interpretation diminishes progressively in the order of criteria from 1 to 5. Conversely, quantitative interpretation diminishes progressively in the order of criteria from 5 to 1. Therefore, Criteria 1 represents 100% qualitative interpretation and Criteria 5 represents 100% quantitative interpretation. However, criteria 2, 3 & 4 have both qualitative and quantitative interpretation. Each criteria indicates a possibility of the type of features identified on the borehole images. Therefore, only one criteria is not sufficient to differentiate between natural versus stress induced tensile fractures. Discrimination of the feature types is based on the maximum number of criteria associated with that feature.

As illustrated in FIG. 14, the data processing system D includes a computer 200 having a processor 202 and memory 204 coupled to the processor 202 to store operating instructions, control information and database records therein. The data processing system D may be a multicore processor with nodes such as those from Intel Corporation or Advanced Micro Devices (AMD), an HPC Linux cluster computer or a mainframe computer of any conventional type of suitable processing capacity such as those available from International Business Machines (IBM) of Armonk, N.Y., or other source. The data processing system D may also be a computer of any conventional type of suitable processing capacity, such as a personal computer, laptop computer, or any other suitable processing apparatus. It should thus be understood that a number of commercially available data processing systems and types of computers may be used for this purpose.

As indicated in FIG. 14, the processor 202 is in the form of a master processor node interacting to control and manage processing operations performed by a suitable number of processor nodes 205. The processor 202 may be in the form of a personal computer having a user interface 206 and an output display 208 for displaying output data or records of processing of seismic survey data according to the present invention. The output display 208 includes components such as a printer and an output display screen capable of providing printed output information or visible displays in the form of graphs, data sheets, graphical images, data plots and the like as output records or images.

The user interface 206 of computer 200 also includes a suitable user input device or input/output control unit 210 to provide a user access to control or access information and database records and operate the computer 200.

Data processing system D further includes a database 214 stored in memory, which may be internal memory 204, or an external, networked, or non-networked memory as indicated at 216 in an associated database server 218. The database 214 also contains various geologic data, borehole image logs and suitable parameters and other data.

The data processing system D includes program code 220 stored in a data storage device, such as memory 204 of the computer 200. The program code 220, according to the present invention is in the form of computer operable instructions causing the data processor 202 to perform the methodology of identifying and discriminating stress types and conditions in formations near walls based on borehole images of the formation borehole walls.

It should be noted that program code 220 may be in the form of microcode, programs, routines, or symbolic computer operable languages that provide a specific set of ordered operations that control the functioning of the data processing system D and direct its operation. The instructions of program code 220 may be stored in non-transitory memory 204 of the computer 200, or on computer diskette, magnetic tape, conventional hard disk drive, electronic read-only memory, optical storage device, or other appropriate data storage device having a computer usable medium stored thereon. Program code 220 may also be contained on a data storage device such as server 208 as a non-transitory computer readable medium, as shown.

The processor 202 of the computer 200 accesses the obtained borehole image logs data and other input data measurements as described above to perform the logic of the present invention, which may be executed by the processor 202 as a series of computer-executable instructions. The stored computer operable instructions cause the data processor computer 200 to identify and determine stress types in formation borehole walls as described in connection with FIG. 13. Results of such processing are then available on output display 208.

From the foregoing it can be understood that the present invention is integrated into a practical application. The present invention solves technological problems in determining stress conditions in subsurface formations located near wellbores and performing well operations in the subsurface formation. As has been described, in deviated wells, natural fractures can appear on borehole images as enhanced features that have a similar appearance to that of stress induced tensile fractures. The present invention differentiates between these two types of subsurface formation stress fractures during the process of borehole image interpretation.

Stress induced tensile fractures which are differentiated according to the present invention permits determining the horizontal principal stress direction in the subsurface formation rock. The horizontal principal stress direction plays an important role in planning of the wells for conventional and unconventional reservoirs. Unconventional wells are drilled in a direction parallel to the direction of minimum principal stress to maximize stimulation and to optimize fluid production. The present invention also avoids drilling of wells in directions which are not parallel to the minimum stress direction, and which thus would will have severe consequences for possible hydrocarbon production.

The present invention in differentiating between fractures permits identification of natural fractures. Natural fractures in a conventional reservoir can together with other exploration and testing data indicate regions of the reservoir which can be "sweet spots" for regions likely to provide enhanced hydrocarbon production. Natural fractures can also in conjunction with other exploration and testing data indicate regions of geological conditions which are likely to cause drilling hazards during drilling of wells. Therefore, identification of natural fractures to confirm the presence of these features in a reservoir can have significant impact on drilling and completion of a well.

Identification of natural fractures in the borehole in conventional reservoirs can help in making the decision for well testing program to target the natural fractures. Thus, differentiation provided by the present invention between stress induced tensile fractures and natural fractures is important in both conventional and unconventional hydrocarbon exploration and development wells. The present invention provides differentiation based on physical measured criteria to discriminate natural fractures from stress induced tensile fractures from borehole image logging results in vertical, deviated and horizontal wells drilled in tectonic stress regimes.

The invention has been sufficiently described so that a person with average knowledge in the field of geomechanical modeling of stress conditions in subsurface formations may reproduce and obtain the results mentioned in the invention herein. Nonetheless, any skilled person in the field of technique, subject of the invention herein, may carry out modifications not described in the request herein, to apply these modifications to a determined structure and methodology, or in the use and practice thereof, requires the claimed matter in the following claims; such structures and processes shall be covered within the scope of the invention.

It should be noted and understood that there are improvements and modifications made of the present invention described in detail above without departing from the spirit or scope of the invention as set forth in the accompanying claims.

What is claimed is:

1. A method of performing well operations in a subsurface formation based on determination of nature of fractures in the subsurface formation, comprising the steps of:

obtaining an image of a borehole wall at a depth of interest in the well with a borehole imaging logging tool;

processing the image of the borehole wall in a data processing system to determine, from the image of the borehole wall, the nature of fractures present in the borehole wall, the data processing system performing the computer implemented steps of:

(a) receiving an indication that the image of the borehole wall is planar or non-planar;

(b) determining, from the image of the borehole wall, a direction of propagation of fractures present in the borehole wall with respect to a longitudinal axis of the borehole;

(c) forming, from the image of the borehole wall, a geomechanical model of stress in the subsurface formation to indicate vectors of component formation stresses;

(d) determining, from the image of the borehole wall, a measure of true dip magnitude and direction of the longitudinal axis of the borehole with respect to a direction of the component formation stress vectors, comprising:

determining, from the image of the borehole wall, a sinusoidal trace of a fracture present in the borehole wall, wherein the presence of the sinusoidal trace is determined when a symmetric appearance of the fracture is identified in the image of the borehole wall;

determining an amplitude of the sinusoidal trace of the fracture present in the borehole wall; and determining, based on the amplitude, the measure of true dip magnitude and the direction of the longitudinal axis of the borehole with respect to the direction of the component formation stress vectors;

(e) forming an indication of the nature of fractures in the borehole wall as stress induced tensile fractures or natural fractures based on the planar or non-planar indication, the determined direction of propagation of fractures in the borehole wall, the vectors of component formation stress in the formed geomechanical model, and the determined measure of true dip magnitude and direction of the longitudinal axis of the borehole with respect to a direction of the component formation stress vectors, the forming comprising indicating a stress induced tensile fracture based on a direction of propagation parallel to the longitudinal axis of the borehole if the well is drilled parallel to a principal stress axis; and indicating a stress induced tensile fracture based on a direction of propagation at an azimuth to a principal stress axis where the compressive stress concentration is a minimum stress; and (f) storing the formed indication of the nature of fractures in a borehole wall for geomechanical modeling of the subsurface formation;

determining, based on the indication of the nature of fractures, a direction for drilling a well in the subsurface formation; and drilling an unconventional well or conventional well in the subsurface formation in the direction determined based on the indication of the nature of fractures.

2. The method of claim 1, wherein the well drilled is an unconventional well.

3. The method of claim 2, further including the step of: performing a formation fracturing operation in the drilled unconventional well in the subsurface formation.

4. The method of claim 1, wherein the unconventional well is drilled in a direction parallel to a horizontal principal stress direction indicated by the stress induced tensile fractures.

5. The method of claim 1, wherein the well drilled is a conventional well.

6. The method of claim 1, wherein the step of drilling comprises drilling the conventional well in a direction indicated by the natural fractures to be of enhanced hydrocarbon production.

7. The method of claim 1, wherein the step of drilling comprises drilling the conventional well in a direction indicated by the natural fractures as unlikely to cause drilling hazards.

8. The method of claim 1, wherein the data processing system comprises a processor and a memory, and further including the data processing system performing the computer implemented steps of:

storing in the memory computer operable instructions causing the processor to determine, from the image obtained, the nature of fractures present in the borehole wall.

9. An apparatus for determining nature of fractures in a borehole wall of a well in a subsurface formation based on borehole images of the borehole wall to perform well operations in the subsurface formation, comprising:

a borehole imaging logging tool obtaining an image of the borehole wall at a depth of interest in the well;

a processor computer processing the image of the borehole wall to determine, from the image of the borehole wall, the nature of fractures present in the borehole wall, the processor computer performing the computer implemented steps of:

(a) receiving an indication that the image of the borehole wall is planar or non-planar;

(b) determining, from the image of the borehole wall, a direction of propagation of fractures present in the borehole wall with respect to a longitudinal axis of the borehole;

(c) forming, from the image of the borehole wall, a geomechanical model of stress in the subsurface formation to indicate vectors of component formation stresses;

(d) determining, from the image of the borehole wall, a measure of true dip magnitude and direction of the longitudinal axis of the borehole with respect to a direction of the component formation stress vectors, comprising:

determining, from the image of the borehole wall, a sinusoidal trace of a fracture present in the borehole wall, wherein the presence of the sinusoidal trace is determined when a symmetric appearance of the fracture is identified in the image of the borehole wall;

determining an amplitude of the sinusoidal trace of the fracture present in the borehole wall; and determining, based on the amplitude, the measure of true dip magnitude and the direction of the longitudinal axis of the borehole with respect to the direction of the component formation stress vectors;

(e) forming an indication of the nature of fractures in the borehole wall as stress induced tensile fractures or natural fractures based on the planar or non-planar indication, the determined direction of propagation of fractures in the borehole wall, the vectors of component formation stress in the formed geomechanical model, and the determined measure of true dip magnitude and direction of the longitudinal axis of the borehole with respect to a direction of the component formation stress vectors, the forming comprising indicating a stress induced tensile fracture based on a direction of propagation parallel to the longitudinal axis of the borehole if the well is drilled parallel to a principal stress axis; and indicating a stress induced tensile fracture based on a direction of propagation at an azimuth to a principal stress axis where the compressive stress concentration is a minimum stress; and (f) storing the formed indication of the nature of fractures in a borehole wall for geomechanical modeling of the subsurface formation;

determining, based on the indication of the nature of fractures, a direction for drilling a well in the subsurface formation; and drilling an unconventional well or conventional well in the subsurface formation in the direction determined based on the indication of the nature of fractures.

10. The apparatus of claim 9, wherein the well drilled is an unconventional well.

11. The apparatus of claim 10, wherein the performed well operations comprise a formation fracturing operation in the drilled unconventional well in the subsurface formation.

12. The apparatus of claim 9, wherein the unconventional well is drilled in a direction parallel to a horizontal principal stress direction indicated by the stress induced tensile fractures.

13. The apparatus of claim 9, wherein the well drilled is a conventional well.

14. The apparatus of claim 9, wherein the performed well operations comprise drilling the conventional well in a direction indicated by the natural fractures to be of enhanced hydrocarbon production.

15. The apparatus of claim 9, wherein performed well operations comprise drilling the conventional well in a direction indicated by the natural fractures as unlikely to cause drilling hazards.

16. A computer implemented method of determining the nature of fractures in a borehole wall of a well in a subsurface formation based on borehole images of the borehole wall to perform well operations in the subsurface formation, the method being performed in a data processing system comprising a processor and a memory and comprising the computer implemented steps of:

storing in the memory computer operable instructions for performing the determination of the nature of fractures in the borehole wall based on borehole images of the borehole wall;

determining in the processor under control of the stored computer operable instructions the nature of the fractures in the borehole wall by performing the computer implemented steps of:

(a) receiving an indication that the image of the borehole wall is planar or non-planar;

(b) determining, from the image of the borehole wall, a direction of propagation of fractures present in the borehole wall with respect to a longitudinal axis of the borehole;

(c) forming, from the image of the borehole wall, a geomechanical model of stress in the subsurface formation to indicate vectors of component formation stresses;

(d) determining, from the image of the borehole wall, a measure of true dip magnitude and direction of the longitudinal axis of the borehole with respect to a direction of the component formation stress vectors, comprising:

determining, from the image of the borehole wall, a sinusoidal trace of a fracture present in the borehole wall, wherein the presence of the sinusoidal trace is determined when a symmetric appearance of the fracture is identified in the image of the borehole wall;

determining an amplitude of the sinusoidal trace of the fracture present in the borehole wall; and determining, based on the amplitude, the measure of true dip magnitude and the direction of the longitudinal axis of the borehole with respect to the direction of the component formation stress vectors;

(e) forming an indication of the nature of fractures in the borehole wall as stress induced tensile fractures or natural fractures based on the planar or non-planar indication, the determined direction of propagation of fractures in the borehole wall, the vectors of component formation stress in the formed geomechanical model, and the determined measure of true dip magnitude and direction of the longitudinal axis of the borehole with respect to a direction of the component formation stress vectors, the forming comprising indicating a stress induced tensile fracture based on a direction of propagation parallel to the longitudinal axis of the borehole if the well is drilled parallel to a principal stress axis; and indicating a stress induced tensile fracture based on a direction of propagation at an azimuth to a principal stress axis where the compressive stress concentration is a minimum stress; and (f) storing the formed indication of the nature of fractures in a borehole wall for geomechanical modeling of the subsurface formation;

determining, based on the indication of the nature of fractures, a direction for drilling a well in the subsurface formation; and drilling an unconventional well or conventional well in the subsurface formation in the direction determined based on the indication of the nature of fractures.

17. The computer implemented method of claim 16, wherein the well drilled is an unconventional well.

18. The computer implemented method of claim 17, wherein the performed well operations comprise a formation fracturing operation in the drilled unconventional well in the subsurface formation.

19. The computer implemented method of claim 16, wherein the unconventional well is drilled in a direction parallel to a horizontal principal stress direction indicated by the stress induced tensile fractures.

20. The computer implemented method of claim 16, wherein the drilled well is a conventional well.

21. The computer implemented method of claim 16, wherein the performed well operations comprise drilling the conventional well in a direction indicated by the natural fractures to be of enhanced hydrocarbon production.

22. The computer implemented method of claim 16, wherein performed well operations comprise drilling the conventional well in a direction indicated by the natural fractures as unlikely to cause drilling hazards.

23. A data processing system for determining the nature of fractures in a borehole wall of a well in a subsurface formation based on borehole images of the borehole wall to perform well operations in the subsurface formation, the data processing system comprising:

a memory storing computer operable instructions for determination of the nature of fractures in the borehole wall based on borehole images of the borehole wall; and a processor operating under control of the stored program instructions to perform the determination of the nature of fractures in the borehole wall by performing the steps of:

(a) receiving an indication that the image of the borehole wall is planar or non-planar;

(b) determining, from the image of the borehole wall, a direction of propagation of fractures present in the borehole wall with respect to a longitudinal axis of the borehole;

(c) forming, from the image of the borehole wall, a geomechanical model of stress in the subsurface formation to indicate vectors of component formation stresses;

(d) determining, from the image of the borehole wall, a measure of true dip magnitude and direction of the longitudinal axis of the borehole with respect to a direction of the component formation stress vectors, comprising:

determining, from the image of the borehole wall, a sinusoidal trace of a fracture present in the borehole wall, wherein the presence of the sinusoidal trace is determined when a symmetric appearance of the fracture is identified in the image of the borehole wall;

determining an amplitude of the sinusoidal trace of the fracture present in the borehole wall; and determining, based on the amplitude, the measure of true dip magnitude and the direction of the longitudinal axis of the borehole with respect to the direction of the component formation stress vectors;

(e) forming an indication of the nature of fractures in the borehole wall as stress induced tensile fractures or natural fractures based on the planar or non-planar indication, the determined direction of propagation of fractures in the borehole wall, the vectors of component formation stress in the formed geomechanical model, and the determined measure of true dip magnitude and direction of the longitudinal axis of the borehole with respect to a direction of the component formation stress vectors, the forming comprising indicating a stress induced tensile fracture based on a direction of propagation parallel to the longitudinal axis of the borehole if the well is drilled parallel to a principal stress axis; and indicating a stress induced tensile fracture based on a direction of propagation at an azimuth to a principal stress axis where the compressive stress concentration is a minimum stress; and (f) storing the formed indication of the nature of fractures in a borehole wall for geomechanical modeling of the subsurface formation;

determining, based on the indication of the nature of fractures, a direction for drilling a well in the subsurface formation; and drilling an unconventional well or conventional well in the subsurface formation in the direction determined based on the indication of the nature of fractures.

24. The data processing system of claim 23, wherein the well drilled is an unconventional well.

25. The data processing system of claim 24, wherein the performed well operations comprise a formation fracturing operation in the drilled unconventional well in the subsurface formation.

26. The data processing system of claim 23, wherein the unconventional well is drilled in a direction parallel to a horizontal principal stress direction indicated by the stress induced tensile fractures.

27. The data processing system of claim 23, wherein the well drilled is a conventional well.

28. The data processing system of claim 23, wherein the performed well operations comprise drilling the conventional well in a direction indicated by the natural fractures to be of enhanced hydrocarbon production.

29. The data processing system of claim 23, wherein performed well operations comprise drilling the conventional well in a direction indicated by the natural fractures as unlikely to cause drilling hazards.

30. A data storage device having stored in a non-transitory computer readable medium computer operable instructions for causing a data processing system comprising a memory and a processor to determine the nature of fractures in a borehole wall of a well in a subsurface formation based on borehole images of the borehole wall to perform well operations in the subsurface formation, the instructions stored in the data storage device causing the data processing system to perform the following steps:

(a) receiving an indication that the image of the borehole wall is planar or non-planar;

(b) determining, from the image of the borehole wall, a direction of propagation of fractures present in the borehole wall with respect to a longitudinal axis of the borehole;

(c) forming, from the image of the borehole wall, a geomechanical model of stress in the subsurface formation to indicate vectors of component formation stresses;

(d) determining, from the image of the borehole wall, a measure of true dip magnitude and direction of the longitudinal axis of the borehole with respect to a direction of the component formation stress vectors, comprising:

determining, from the image of the borehole wall, a sinusoidal trace of a fracture present in the borehole wall, wherein the presence of the sinusoidal trace is determined when a symmetric appearance of the fracture is identified in the image of the borehole wall;

determining an amplitude of the sinusoidal trace of the fracture present in the borehole wall; and determining, based on the amplitude, the measure of true dip magnitude and the direction of the longitudinal axis of the borehole with respect to the direction of the component formation stress vectors;

(e) forming an indication of the nature of fractures in the borehole wall as stress induced tensile fractures or natural fractures based on the planar or non-planar indication, the determined direction of propagation of fractures in the borehole wall, the vectors of component formation stress in the formed geomechanical model, and the determined measure of true dip magnitude and direction of the longitudinal axis of the borehole with respect to a direction of the component formation stress vectors, the forming comprising indicating a stress induced tensile fracture based on a direction of propagation parallel to the longitudinal axis of the borehole if the well is drilled parallel to a principal stress axis; and indicating a stress induced tensile fracture based on a direction of propagation at an azimuth to a principal stress axis where the compressive stress concentration is a minimum stress; and (f) storing the formed indication of the nature of fractures in a borehole wall for geomechanical modeling of the subsurface formation;

determining, based on the indication of the nature of fractures, a direction for drilling a well in the subsurface formation; and drilling an unconventional well or conventional well in the subsurface formation in the direction determined based on the indication of the nature of fractures.

* * * * *